US006000921A

United States Patent [19]

Yang

[11] Patent Number: 6,000,921

[45] Date of Patent: Dec. 14, 1999

[54] FLUID PUMP HAVING A SLIDER AND A ROTARY DISK

[76] Inventor: Gene-huang Yang, P.O. Box 55-175, Taichung, Taiwan

[21] Appl. No.: 08/887,689

[22] Filed: Jul. 3, 1997

[30] Foreign Application Priority Data

Mar. 20, 1997 [TW] Taiwan ..... 86204297

[51] Int. Cl.[6] ..... F04C 2/00

[52] U.S. Cl. ..... 418/240; 418/247

[58] Field of Search ..... 418/88, 240, 245, 418/247

[56] References Cited

U.S. PATENT DOCUMENTS 654,721 7/1900 Flint ..... 418/240
1,157,806 10/1915 Rixen ..... 418/240
5,324,183 6/1994 Capelle ..... 418/102
5,707,224 1/1998 Yang ..... 418/240

*Primary Examiner*—John J. Vrablik

[57] ABSTRACT

A fluid pump for transferring liquid material from one container to another is provided. The fluid pump is of a novel structure which comprises a circular base having a less diameter annular projection at a central portion and first guide slot radially formed through the body, an external annulus having a pair of second guide slots made in registry with the first guide slot to define a rectangular space therebetween for facilitating a slider to slide thereabout; a rotary disk disposed into the annulus including a plunger and pushing rod at under side for synchroneously sliding in a fluid channel and actuating the slider to move about so as to repeatedly alter the vacuum state in the pump for sucking the liquid material from one container and simultaneously discharging the sucked liquid material to another container.

6 Claims, 8 Drawing Sheets

FLUID PUMP HAVING A SLIDER AND A ROTARY DISK

BACKGROUND OF THE INVENTION

The present invention relates to liquid transferring devices, and more particularly to a novel fluid pump which includes a rotary plunger and a rectangular slider transversely sliding about a guide groove in the pump perpendicular to the plunger. Their coactions repeatedly and alternately dispatch the fluid in an annular channel in the pump and in cooperation with the pairs of check valves which control the fluid orientation so as to suck and synchroneously discharge the liquid material from one container to another.

Typical liquid tranferring devices include generally a gear pump, a vane pump or a plunger pump which have their common disadvantages of greater vibration and noise and easpecially high abrasion ratio caused by a lateral component of force.

To obviate above disadvantages, my previous U.S. patent application Ser. No. 08/727,270, filed Oct. 8, 1996, U.S. Pat. No. 5,707,224, provides a rotary plunger coacting with a perpendicular transverse elongate slider sliding about a circular chamber in the pump for obtaining a circulate fluid in the pump to transfer the liquid material from one container to another so as to reduce the vibration and the noise and obviate the lateral component of force in the pump in order to promote its efficiency. However, the components adapted therein are slightly complicated and couldn't reduce the cost to manufacture.

SUMMARY OF THE PRESENT INVENTION

The present invention has a main object to provide a fluid pump which provides a novel structure of low vibration, less noise and high efficiency.

Another object of the present invention is to provide a fluid pump which obviates gears and other sophiscated components in order to reduce the cost to manufacture and lessening the difficulty to assemble.

Accordingly, the fluid pump of the present invention comprises general a circular base on which an annular projection is concentrically formed at the central portion, a guide slot radially formed across the center of the base through the annular projection and terminated at the opposing circumferences of the base for receiving a rectangular slider which is actuated by a rotary disk to slide about the groove for repeatedly closing and opening an annular fluid channel formed between the base and an external annulus, pairs of check valves secured to the threaded aperture in the opposing circumferential walls of the annulus to control the fluid orientations. So that the liquid material is continuously sucked from one container and repeatedly and alternately dispatch to discharge into another container.

The present invention will become more fully understood by reference to the following detailed description thereof when read in conjunction with the attached drawings.

DETAILED DESCRIPTION OF THE PREFERRED EMBODIMENT

Figures 1, 1A:
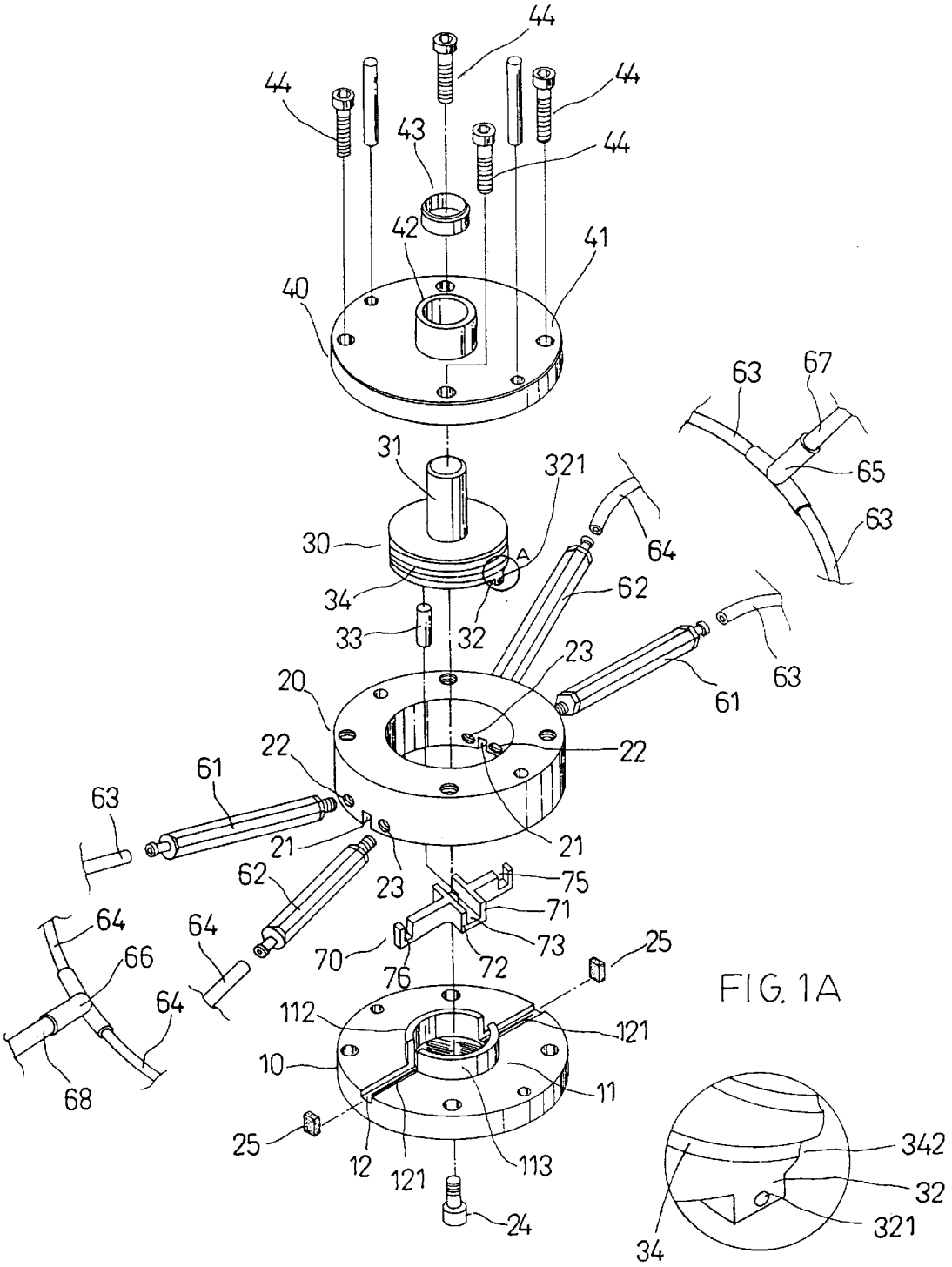
FIGS. 1 and 1A are the exploded perspective views to show the preferred embodiment of the present invention.
Figure 2:
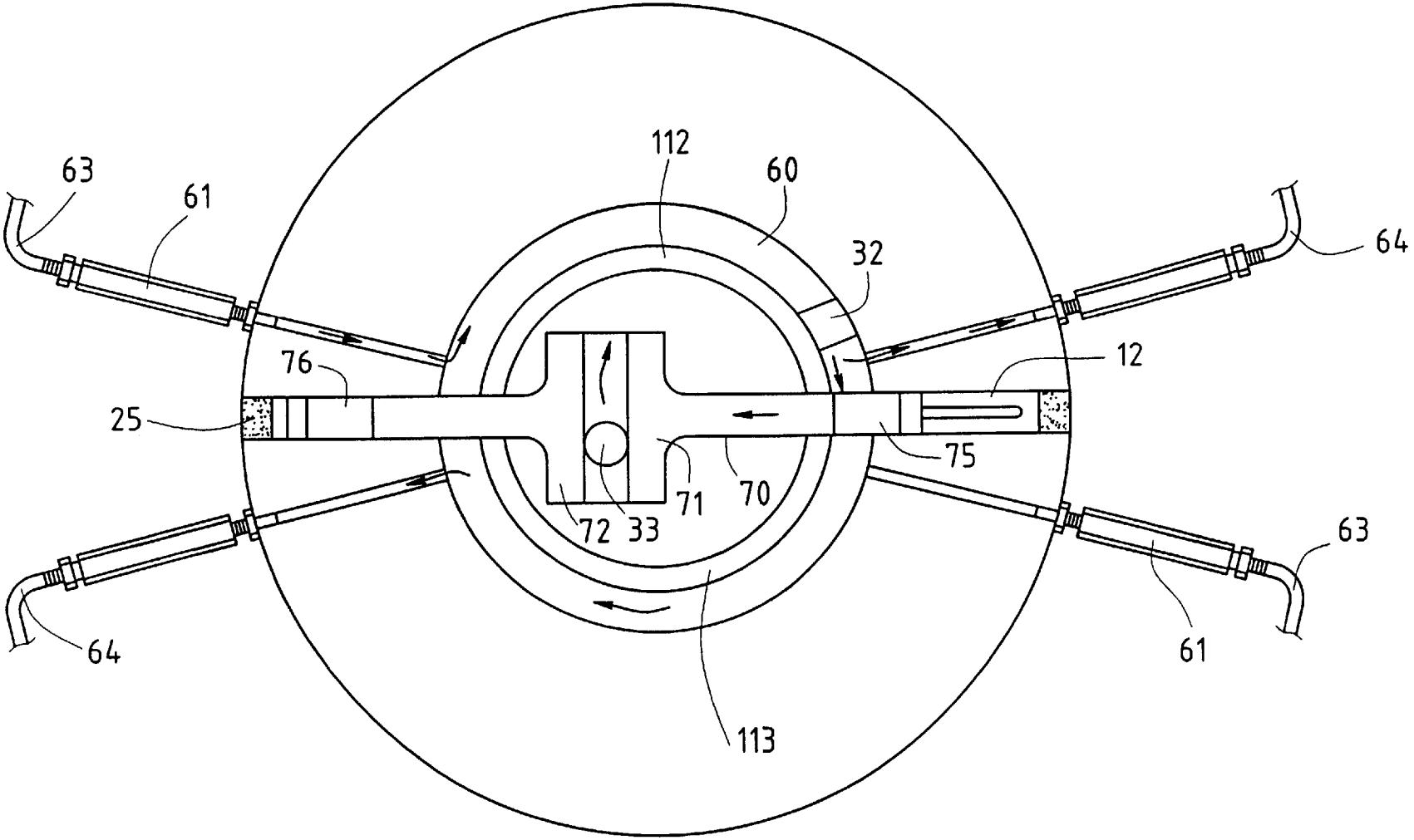
FIGS. 2 to 5 are the top views to illustrate the operation of the preferred embodiment of the present invention.
Figure 3:
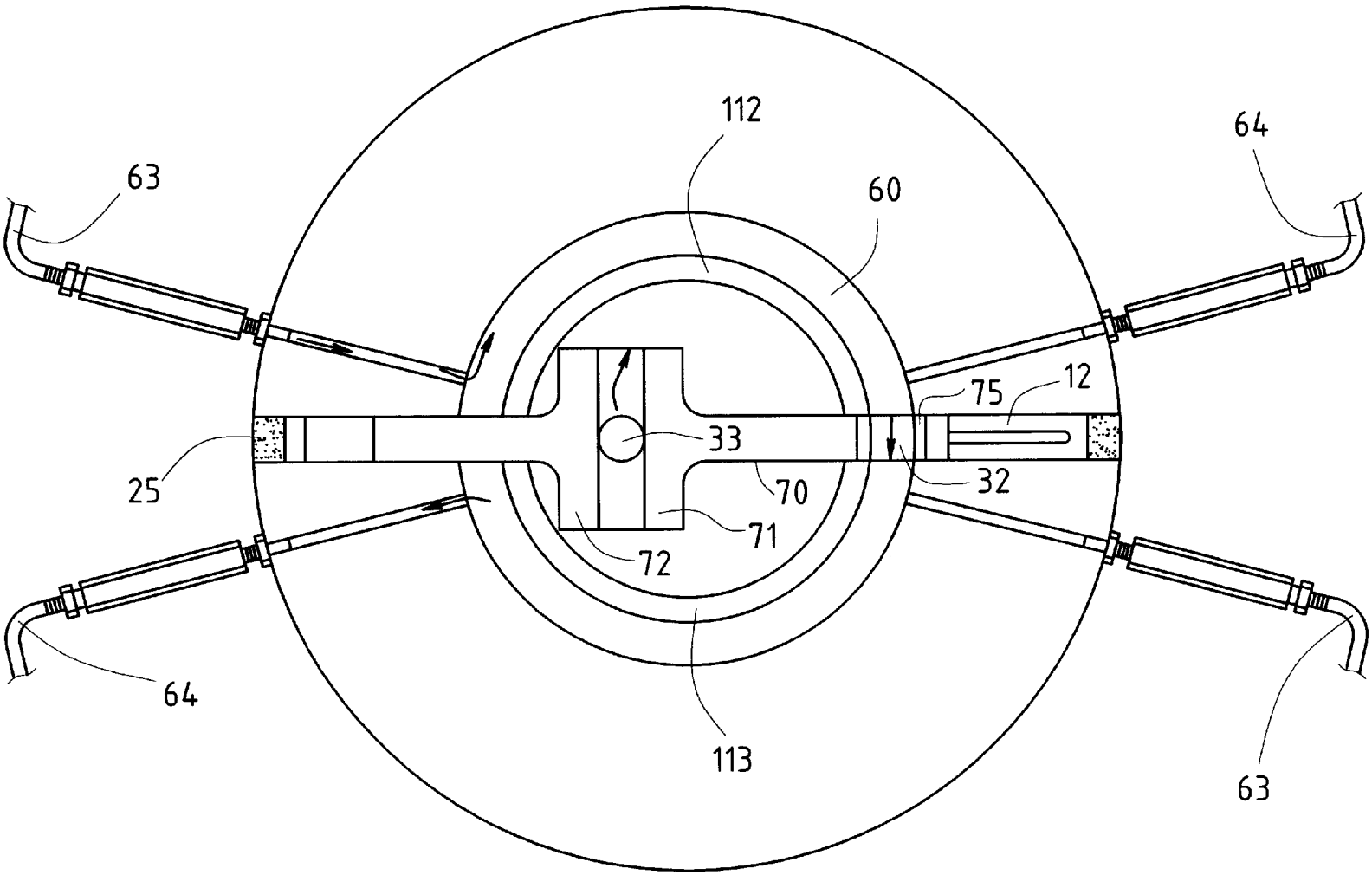
Figure 4:
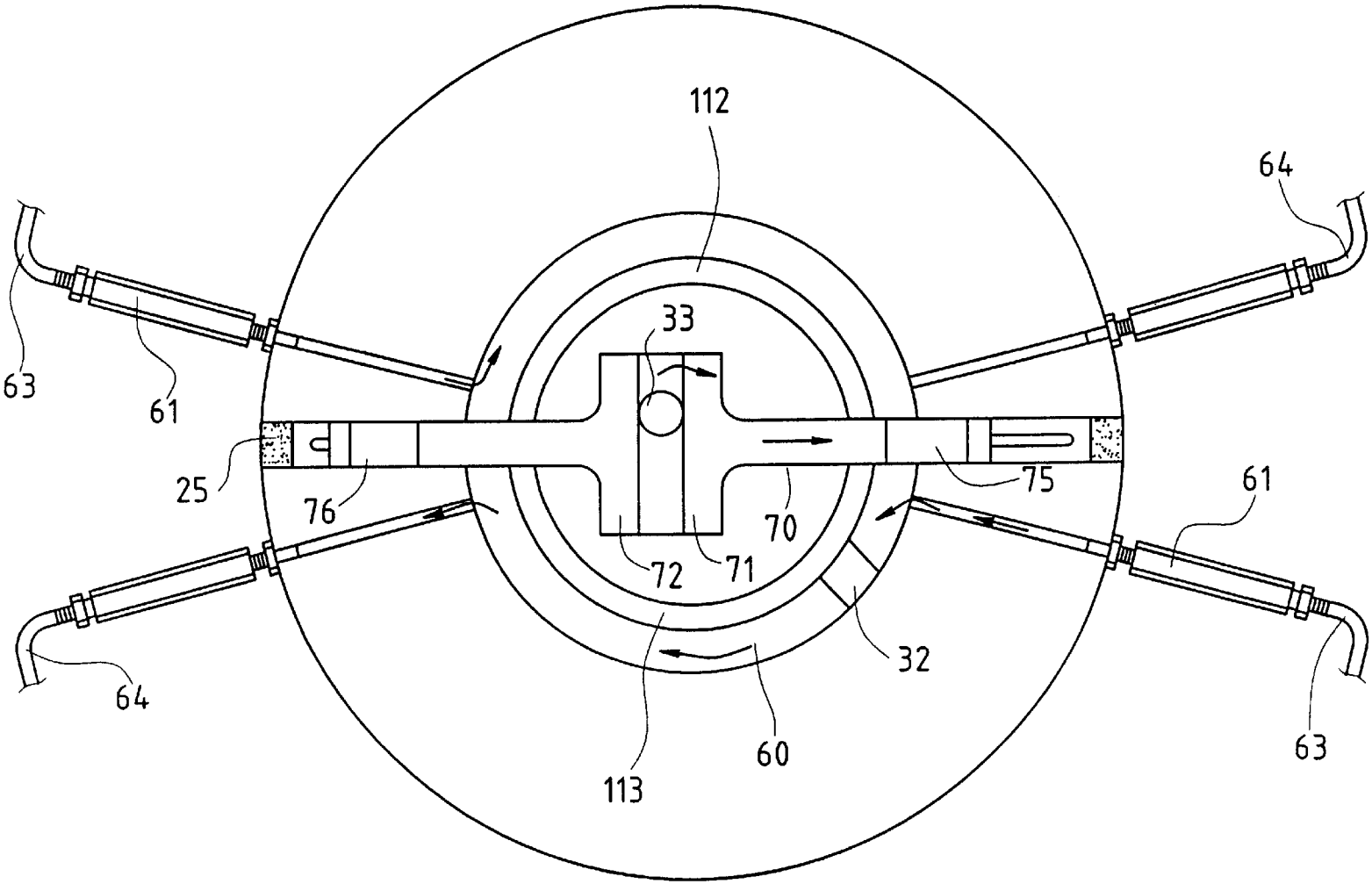
Figure 5:
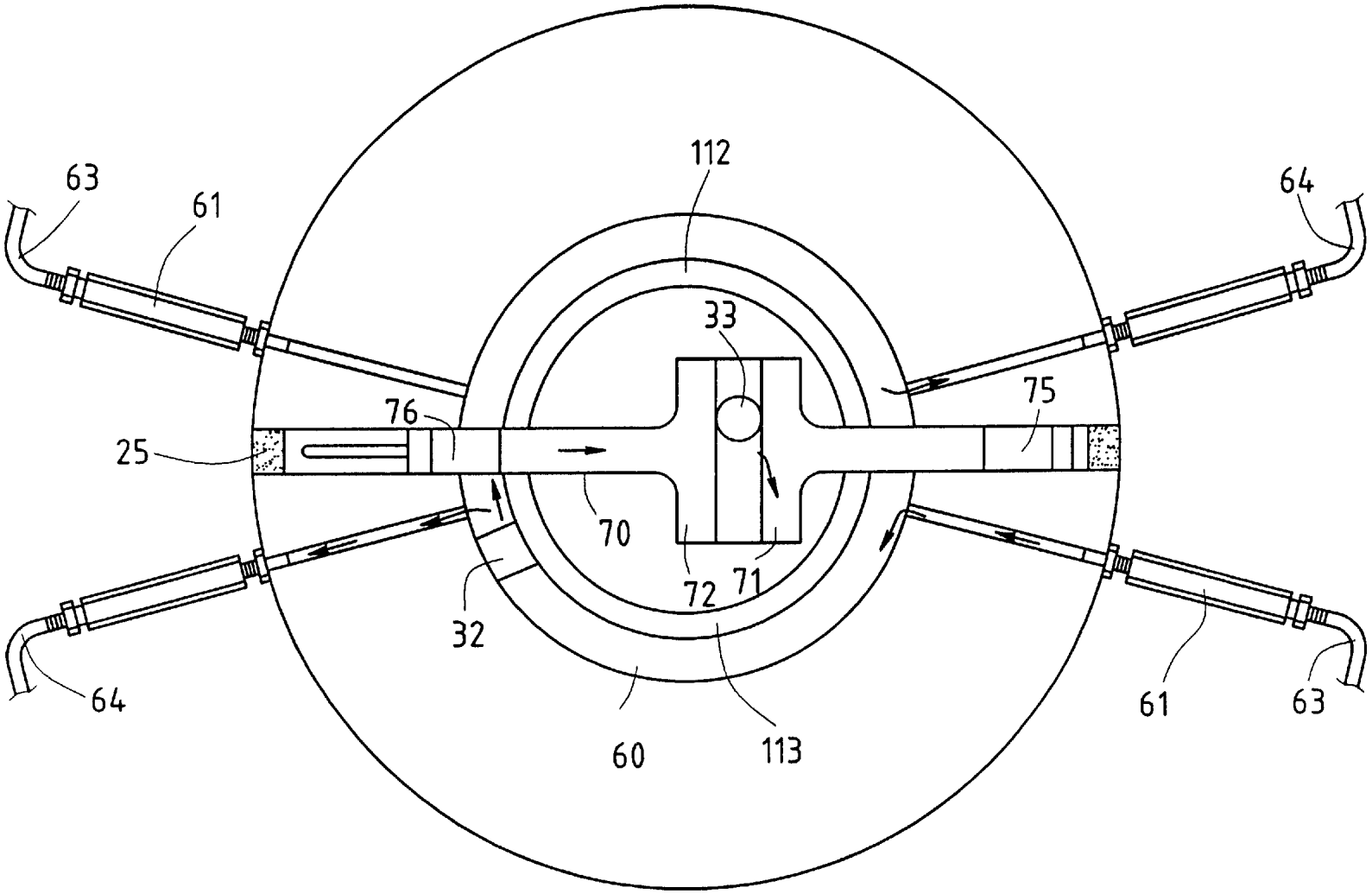

With reference to the drawings and initiating from FIGS. 1 and 1A, the fluid pump of the present invention comprises generally a circular base 10, an external annulus 20, a rotary disk 30 and a cap 40, wherein the circular base 10 includes a smaller diameter annular projection 11 concentrically projected upward from the central portion of the base 10 and a first guide slot 12 radially extended in the upper surface across the center of the base 10 through the projection 11 and terminated at the opposite circumferences of the base 10 so as to divide the annular projection 11 into a pair of first and second semi-annular portions 112 and 113. The circular surface enclosed by the annular projection 11 has a depth slightly deeper than the depth of the guide slot 12. The external annulus 20 has an inner diameter larger than the outer diameter of the annular projection 11 so as to regularly define an annular fluid channel 60 therebetween when the annulus 20 engages with the circular base 10. The annulus 20 includes a pair of second guide slots 21 extended radially in the under side of the opposite circumferences which are made in registry with the first guide slot 12 of the base 10. Abutting the lateral sides of each of the second guide slots 21, there are a first and a second threaded thru hole 22 and 23 parallel formed and through the circumference of the annulus 20.

A roughly rectangular slider 70 is slidably disposed into the space defined by the first and second guide slots 12 and 21. The slider 70 includes a transverse groove 73 extended laterally from a middle portion and perpendicular to the main body so as to define a pair of first and second limit walls 71 and 72 at two sides of the groove 73, a pair of first and second rectangular passages 75 and 76 symmetrically formed at two ends. The slider 70 has a length longer than the outer diameter of the annular projection 11 and its transverse groove 73 has a length less than the inner diameter of the projection 11 so as to permit the slider 70 to be slid thereabout. A balancement concave 121 is symmetrically and centrally formed in the bottom of each end of the first guide slot 12 and terminated into the annular projection 11. This arrangement aims to prevent partial pressure that may be constituted to disturb the smooth operation of the slider 70.

A pair of first check valves 61 and a pair of second check valves 62 alternately and respectively engage into the first and second threaded thru holes 22 and 23 in the opposite circumferences of the external annulus 20, each of the check valves 61 and 62 has a threaded end made in registry with the threaded thru holes 22 and 23 and a neck at the other end engageable with two pairs of the first hoses 63 and second hoses 64. The pair of first hoses 63 have their first ends respectively engaged with the first check valves 61 and their second ends with a first T-pipe 65 which has a perpendicular portion connected to an inlet hose 67. Similarly, the pair of second hoses 64 have their first ends respectively engaged with the second check valves 62 and their second ends with a second T-pipe 66 which includes a perpendicular portion connected to an outlet hose 68.

The rotary disk 30 has an outer diameter equal to the inner diameter of the external annulus 20 so as to rotatably engage into the central circular space of the annulus 20 and stop on the under side thereof against the top of the annular projection 11 when the pump is assembled. The rotary disk 30 has an axis 31 centrally projected upward from the top thereof which connects to an external power source (not shown) for rotating the disk 30, an arcuate rectangular plunger 32 projected downward from an under side abutting the circumference thereof including a radial hole 321 through the body for releasing the fluid pressure, a pushing rod 33 perpendicularly engaged into the under side of the disk 30 at a predetermined position along a radial line with the plunger 32 but opposite to each other and a spiral groove 34 formed in the outer peripheral wall of the disk 30 (as shown in FIG. 1A). Wherein the plunger 32 has a radial dimension slightly smaller than that of the passages 75 and 76 and the radial section of the annular fluid channel 60 between the annulus 20 and the annular projection 11 so that the plunger 32 can rotate about the channel 60 and pass through the passages 75 and 76, the pushing rod 33 is confined within the transverse groove 73 of the slider 70 and alternately pushes the limit walls 71 and 72 so that the slider 70 is pushed to slide about the slot 12 in concert with the rotation of the rotary disk 30, and the spiral groove 34 has an opening 342 at a lower end communicating with the annular fluid channel 60 and a closed upper end behind the forward direction of the pushing rod 32 and rotated in conforming with the rotation of the rotary disk 30 so as to lead the upward fluid into the annular fluid channel 60 to prevent the liquid material therein from leaking out of the pump.

The cap 40 comprises a circular body 41 diametrically equal to that of the external annulus 20 and the circular base 10 and a protrudent neck 42 centrally projected upward from the top engageable with the axis 31 of the rotary disk 30 therein with a bearing 43 therebetween.

Both the circular base 10, the annulus 20 and the cap 40 have corresponding vertical screw holes through their circumferences and fastened by a plurality of first bolts 24 and second bolts 44. Further, a pair of stuffing members 25 block two ends of the slot 12 for preventing the liquid material from leaking out of the pump.

Figure 6:
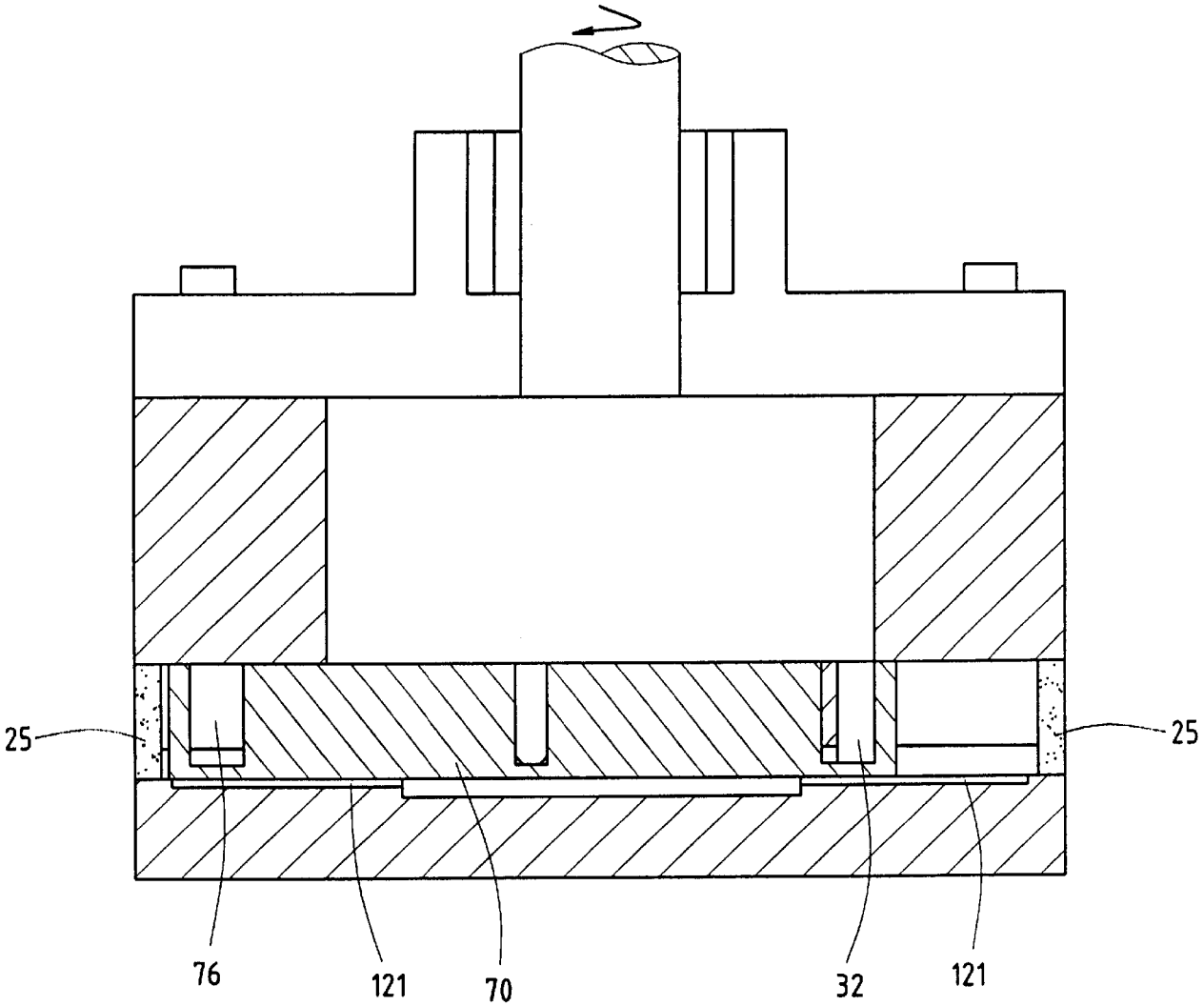
FIG. 6 is a sectional view to illustrate the operation of the preferred embodiment of the present invention.

Referring to FIGS. 2 to 5 of the drawings, in operation, when the rotary disk 30 is actuated to rotate, the plunger 32 goes steadfastly around the annular fluid channel 60 and the pushing rod 33 opposite to the plunger 32 will rotate to alternately push the first and second limit walls 71 and 72 so as to force the slider 70 sliding about the straight space defined by the first and second guide slots 12 and 21. When the plunger 32 reaches the slider 70, the slider 70 has been simultaneously moved leftward by the pushing rod 33, so that the first passage 75 just engages with the fluid channel 60 for permitting the plunger 32 to pass through the passage 75 and enter into the second semi-annular portion 113 from the first semi-annular portion 112 and then the passage 75 is closed because of the further leftward sliding of the slider 70. So that the first semi-annular portion 112 becomes firstly a vacuum state for sucking the liquid material from one of the first check valves 61 into the second semi-annular portion 113. When the plunger 32 passes through the second passage 76 of the slider 70 entered into the first semi-annular portion 112, the same vacuum state is constituted therein as recited in the first semi-annular portion 112. When the plunger 32 passes through the first passage 75 again, the annular fluid channel 60 is full of the liquid material. So that the plunger 32 continuously sucks the liquid material from the first check valves 61 and simultaneously dispatch the liquid material from the channel 60 into the second check valves 62. Since the rotary disk 30 rotates constantly, the fluid pump will continuously transfer the liquid material from one container to another. Note that the sliding of the slider 70 will cause a state that when one end of the slider 70 departs from the stuffing member 25 will constitute a pressure decreasing, whereas if the slider 70 closes the stuffing member 25 will constitute a pressure increasing, which may disturb the smooth sliding of the slider 70. The concave 121 (FIG. 6) can solve this problem.

A spiral groove 34 is formed in outer peripheral wall of the rotary disk 30 to lead the fluid into the channel 60. This arrangement also enables the preventing the liquid material from leaking out of the pump (as shown in FIG. 7).

Figure 7:
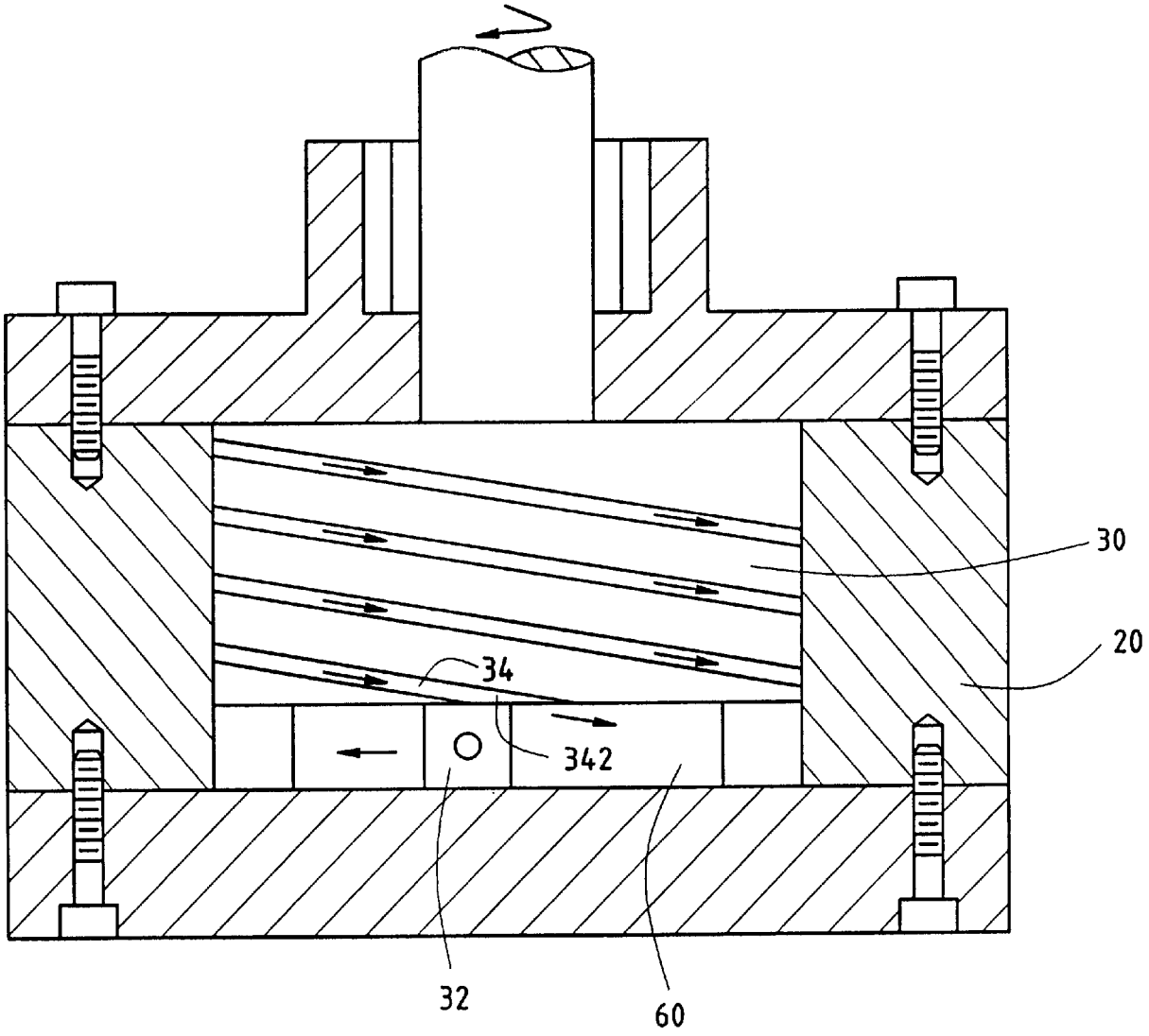
FIG. 7 is a sectional view to show a spiral fluid channel in the outer peripheral wall of the rotary plunger.

Referring to FIG. 7, as we know that the forward movement of the plunger 32 constitutes dynamic pressure as will as the hydrostatic pressure in the channel 60, the radial through hole 321 can release the pressures.

Figure 8:
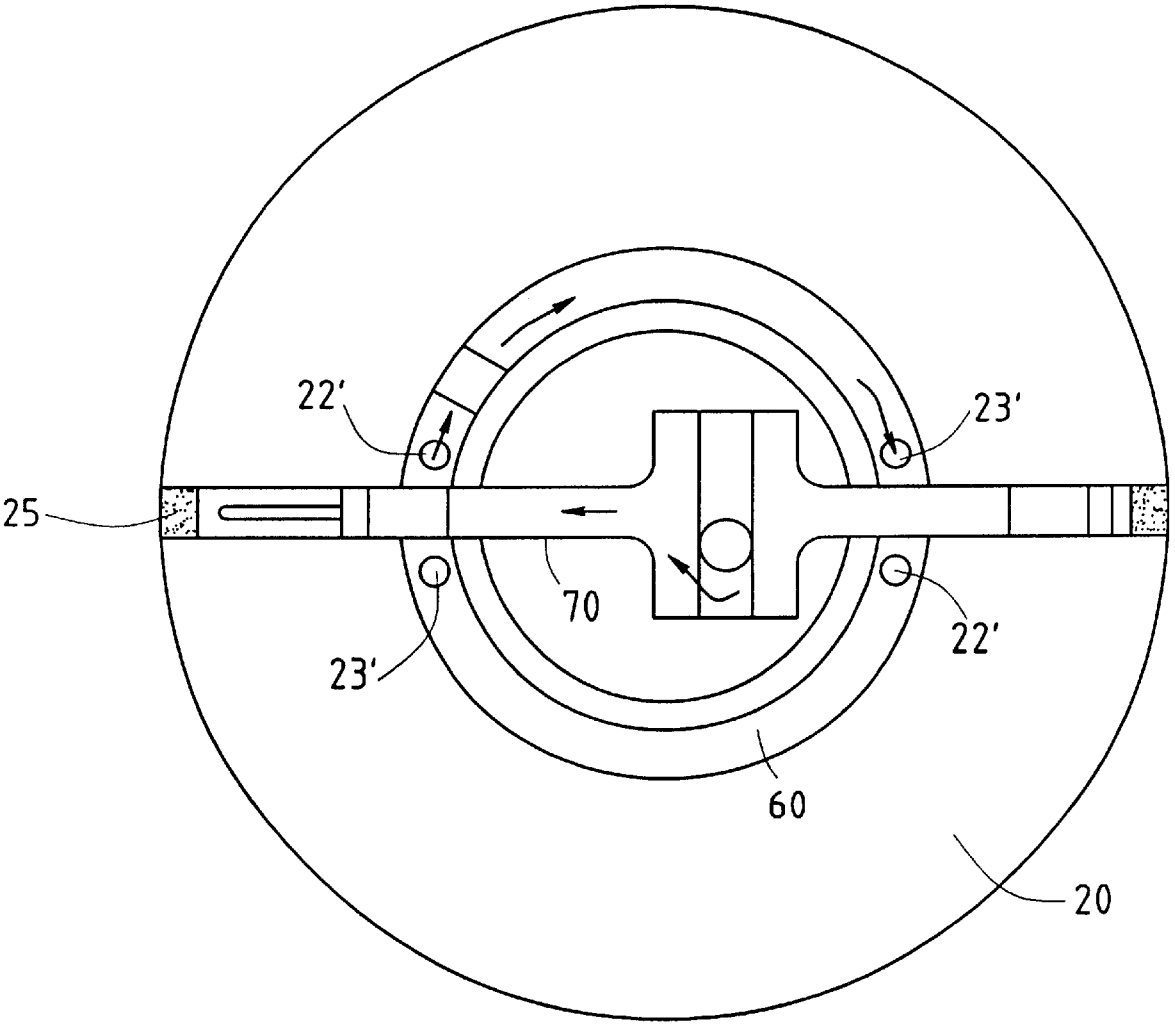
FIG. 8 is a top view to show an alternate embodiment of the present invention.

Referring to FIG. 8, which show an alternate embodiment of the present invention, in which the structure and functions are similar to that recited above for FIGS. 7–7 and the above discussions are mostly applicable to this instance.

The only modification is made to the external annulus 20 and the circular base 10, wherein the first and second threaded thru holes 22 and 23 are omitted from the external annulus 20. Instead, there is a pair of third threaded thru holes 22' and a pair of fourth threaded thru holes 23' vertically and alternately formed in the circular base 10 abutting the lateral sides of the first guide slot 12 and at a position where the annular fluid channel 60 is defined. So that the first and second check valves 61 and 62 directly and alternately connect the vertical thru holes 22' and 23' from the under side of the circular base 10. This arrangement can also obtain the objects recited in the first embodiment.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A fluid pump for transferring liquid material from one container to another comprising:

a circular base including a smaller diameter annular projection concentrically projected upward from a central portion and a first guide slot radially extended in the upper surface through the center and the annular projection and terminated at the opposing circumference thereof, said first guide slot further including an elongate concave centrally formed in the bottom of two ends and terminated into a smaller diameter circular portion defined by the annular projection;

an external annulus engageable with said circular base, said annulus having an outer diameter equal to that of said circular base and an inner diameter larger than the outer diameter of the annular projection so as to define an annular fluid channel therebetween when engaged, a pair of second guide slots radially formed in an under side in opposing circumferential walls which are made in registry with the first guide slot so as to define a sliding space therebetween for a slides sliding about therein; a pair of first threaded thru holes and a pair of second threaded thru holes alternately and parallel extended in the opposing circumferential walls abutting lateral sides of the pair of the second guide slots for respectively and alternately engaging with a pair of first and a pair of second check valves therein;

a rotary disk including a circular body rotatably engageable with said external annulus therein with the under side thereof stopped against the top of said annular projection, said rotary disk having a central axis projected upward from an upper surface, an arcuate rectangular plunger slidable within the annular fluid channel and projected downward from abutting a circumference and including a radial thru hole formed therethrough, a pushing means operatively associated with said slider and projected downward from an under side of said rotary disk and along a radial line opposite to the plunger, and said rotary disk having a spiral groove formed in a peripheral wall including an opening toward the annular fluid channel and a closed end at an upper portion of the wall top behind the pushing means;

a cap having a circular body of a diameter equal to said external annulus and said circular base so as to sequentially engage with one another and fastened by means of first and second bolts from opposite sides thereof, said cap including a protrudent neck projected upward from the central thereof engageable with the central axis of said rotary disk by a bearing means, said central axis connects to an external power source for actuating the rotary disk to rotate constantly in the pump.

2. A fluid pump as recited in claim 1 wherein said slider comprises a roughly rectangular body including a first and a second passage at two ends for the plunger to pass through and a transverse groove at a middle portion perpendicular to the body for engaging the pushing means therein, said groove defines a pair of first and second limit walls for confining movement of the pushing means.

3. A fluid pump as recited in claim 1 wherein said first check valves each has a threaded first end connected to respective first threaded thru holes and a neck at a second end connected with respective first hoses which are then connected to a first T-pipe communicating to an inlet hose.

4. A fluid pump as recited in claim 1 wherein said second check valves each has a threaded first end connected to respective second threaded thru holes and a neck at a second end connected with respective second hoses which are then connected to a second T-pipe communicating to an outlet hose.

5. A fluid pump for transferring liquid material from one container to another comprising:

a circular base including a smaller diameter annular projection concentrically projected upward from a central portion, a first guide slot radially extended in the upper surface through the center and the annulus projection and terminated at opposing circumferences thereof, a pair of elongate concaves centrally extended along the bottom of two ends of the first guide slot and terminated into a smaller diameter circular portion defined by the annular projection, an external annulus engageable with said circular base, said annulus having an outer diameter equal to that of said circular base and an inner diameter larger than the outer diameter of the annular projection so as to define an annular fluid channel therebetween when engaged, a pair of second guide slots radially formed in an under side in opposing circumferential walls which are made in registry with the first guide slot so as to define a sliding space therebetween for a slides sliding about therein; a pair of first threaded thru holes and a pair of second threaded thru holes alternately and parallel extended in the opposing circumferential walls abutting lateral sides of the pair of the second guide slots for respectively and alternately engaging with a pair of first and a pair of second check valves therein;

a rotary disk including a circular body rotatably engageable with said external annulus therein with the under side thereof stopped against the top of said annular projection, said rotary disk having a central axis projected upward from an upper surface, an arcuate rectangular plunger slidable within the annular fluid channel and projected downward from abutting a circumference and including a radial thru hole formed therethrough, a pushing means operatively associated with said slider and projected downward from an under side of said rotary disk and along a radial line opposite to the plunger, and said rotary disk having a spiral groove formed in a peripheral wall including an opening toward the annular fluid channel and a closed end at an upper portion of the wall top behind the pushing means;

a cap having a circular body of a diameter equal to said external annulus and said circular base so as to sequentially engage with one another and fastened by means of first and second bolts from opposite sides thereof, said cap including a protrudent neck projected upward from the center thereof engageable with the central axis of said rotary disk by a bearing means, said central axis connects to an external power source for actuating the rotary disk to rotate constantly in the pump;

said first guide slot of said circular base being made in registry with the second guide slots of said external annulus, said circular base including a pair of third threaded thru holes and a pair of fourth threaded thru holes alternated and vertically formed on lateral side of two ends of the first guide slot at a position where the annular fluid channel is defined between the annular projection and the inner periphery of said external annulus; said third and fourth threaded thru holes being enabled to connect with the first and second check valves.

6. A fluid pump as recited in claims 1 or 5 further has a pair of stuffing means stuffed at two ends of the space defined by the first and second guide slots.

* * * * *